US006440643B1

(12) United States Patent
Calistri-Yeh et al.

(10) Patent No.: US 6,440,643 B1
(45) Date of Patent: Aug. 27, 2002

(54) METHOD OF MAKING INKJET PRINT HEAD WITH PATTERNED PHOTORESIST LAYER HAVING FEATURES WITH HIGH ASPECT RATIOS

(75) Inventors: Mildred Calistri-Yeh, Webster; Cathie J. Burke, Rochester; Diane Atkinson, Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/921,112

(22) Filed: Aug. 2, 2001

Related U.S. Application Data

(62) Division of application No. 09/352,956, filed on Jul. 14, 1999, now Pat. No. 6,294,317.

(51) Int. Cl.[7] ..... B41J 2/135
(52) U.S. Cl. ..... 430/320; 430/319; 347/20
(58) Field of Search ..... 347/20; 430/17, 430/18, 320, 319

(56) References Cited

U.S. PATENT DOCUMENTS

| | | | | |
|---|---|---|---|---|
| 4,535,053 A | | 8/1985 | West et al. | 430/312 |
| 4,578,344 A | | 3/1986 | Griffing et al. | 430/312 |
| 4,663,275 A | | 5/1987 | West et al. | 430/271 |
| 4,677,049 A | | 6/1987 | Griffing et al. | 430/339 |
| 4,702,996 A | | 10/1987 | Griffing et al. | 430/325 |
| 4,990,665 A | | 2/1991 | Griffing et al. | 564/265 |
| 5,002,993 A | | 3/1991 | West et al. | 524/236 |
| 5,106,723 A | | 4/1992 | West et al. | 430/325 |
| 5,108,874 A | | 4/1992 | Griffing et al. | 430/273 |
| 5,196,295 A | | 3/1993 | Davis | 430/273 |
| 5,290,667 A | | 3/1994 | Shiba et al. | 430/328 |
| 5,344,748 A | * | 9/1994 | Feely | 430/330 |
| 5,375,326 A | | 12/1994 | Usui et al. | 29/890.1 |
| 5,557,308 A | | 9/1996 | Chandrasekaran | 347/65 |
| 5,582,678 A | | 12/1996 | Komuro | 216/27 |
| 5,665,249 A | | 9/1997 | Burke et al. | 216/2 |
| 5,686,224 A | | 11/1997 | O'Neil | 430/320 |
| 5,738,799 A | | 4/1998 | Hawkins et al. | 216/27 |
| 6,109,096 A | * | 8/2000 | Komplin et al. | 347/20 |
| 6,161,923 A | * | 12/2000 | Pidwerbecki et al. | 347/63 |

OTHER PUBLICATIONS

A. Bruno Frazier, "Uses of Polyimide for Micromachining Applications," IEEE pp. 1483–1487, 1994.

S.G. Hagen et al., "Photosensitive Polyimide: Lithography in the Thick–Film Regime," *Proceedings of the 11th International Conference Photopolymers Principles, Processes, and Materials Oct. 6–8, 1997*; Society of Plastics Engineers, Inc., pp. 421–437.

* cited by examiner

*Primary Examiner*—Janet Baxter
*Assistant Examiner*—Barbara Gilmore
(74) *Attorney, Agent, or Firm*—Oliff & Berridge, PLC

(57) ABSTRACT

Patterned photoresist layers formed on substrates have features with high aspect ratios. The photoresist layers can be formed as single layers with aspect ratios as high as about 4:1. In addition, the features in the photoresist layers can have a wide range of aspect ratios in a given single layer. The photoresist layers can be used in ink jet print heads and other devices to provide controlled fluid flow. The photoresist layers are formed using a contrast enhancement material that enables features having substantially vertical side walls and high aspect ratios to be formed.

17 Claims, 9 Drawing Sheets

METHOD OF MAKING INKJET PRINT HEAD WITH PATTERNED PHOTORESIST LAYER HAVING FEATURES WITH HIGH ASPECT RATIOS

This application is a divisional of application(s) Ser. No(s). 09/352,956, filed Jul. 14, 1999, U.S. Pat No. 6,294, 317.

BACKGROUND OF THE INVENTION

1. Field of Invention

This invention relates to patterned photoresist structures including features having high aspect ratios. This invention further relates to methods of forming the patterned photoresist structures.

2. Description of Related Art

Photolithography is widely used to make very accurate microscopic patterns in a material, such as photoresist. Traditionally, photoresist is coated onto a substrate, and light or other radiation passing through a patterned mask transfers the pattern into the resist layer. After development, the pattern exists in the photoresist and can be utilized. Commercial photoresists are complex blends of polymeric and other organic and inorganic materials. The two broad classifications of photoresists are negative and positive resists that produce negative and positive images, respectively. In a negative resists, regions that are exposed to light are polymerized and, consequently, more insoluble to the developer. Thus the regions that are not exposed to light are preferentially removed during development. Positive resists have different chemistries from negative resists. When regions of positive resists are exposed to light, they are changed to have a higher degree of solubility and are preferentially removed during development. The selection of a negative or positive photoresist would depend on the full details of the particular application; namely, details such as resolution, exposure equipment, chemical selectivity, film thickness and chemical requirements. Photoresists are patterned to form features. In many microelectronics applications, photoresists are removed from the underlying substrate after the substrate has been etched, transferring the complement of the pattern from the photoresist to the substrate. Wet stripping solutions, dry etching techniques and high-temperature ashing techniques may be used to remove the photoresists from the substrates.

In addition to their temporary use in microelectronics applications, photoresists have been used both as temporary sacrificial layers and as permanent structural layers in micromechanical devices, as described in "Photosensitive Polyimide: Lithography in the Thick-Film Regime," S. G. Hagen, R. E. Hopla, L. J. Peterson, D. W. Racicot, A. J. Roza, A. Schaffner and W. D. Weber, *Proceedings of the Eleventh International Conference on Photopolymers*, Society of Plastics Engineers, Inc., Oct. 6–8, 1997, pp. 422–437; which is incorporated herein by reference in its entirety.

One such known application of photoresist layers has been in ink jet printers. Inkjet print heads have a structure including a base plate and a cover plate. The ink jet print head can also include an intermediate layer disposed between the top plate and the bottom plate. The intermediate layer and the base and/or cover plates have structures that form ink channels and nozzles for flowing and discharging the ink onto a recording medium. Heating elements such as microresistors or piezo elements are provided in or on the base plate in alignment with the ink nozzles to cause ink droplets to be discharged out of the nozzles and onto the recording medium.

Photoresist layers have been used in a sacrificial mode to form the intermediate layer, as described in U.S. Pat. No. 5,738,799 to Hawkins et al. The photoresist layer represents the configuration of ink passages or capillary channels that are formed in the finished print head. The photoresist layer is removed during formation of the print head to define the ink passages. U.S. Pat. No. 5,290,667 to Shiba et al. describes a method for producing an ink jet print head that includes the use of positive photoresists to form ink paths in a layer formed on a substrate.

Photoresist layers have also been used as permanent structural layers in ink jet print heads. For example, U.S. Pat. No. 5,582,678 to Komuro describes using both negative photoresists and positive photoresists to form an intermediate layer in an ink jet recording head. The negative photoresist is patterned to form features having the configuration of ink pathways. The positive photoresist is filled into the ink pathways and then removed such that the negative photoresist forms a permanent structural layer including the ink pathways.

U.S. Pat. No. 5,557,308 to Chandrasekaran describes an ink jet print head including a negative photoresist layer disposed between a top plate and a bottom plate. The negative photoresist layer forms a permanent structural layer defining the ink channels in the ink jet print head.

It is also known to form the photoresist in multiple separate layers in ink jet print heads. For example, U.S. Pat. No. 5,375,326 to Usui et al. describes a method of manufacturing an ink jet print head in which a plurality of negative photoresist layers are successively applied on each other and patterned to form flow paths. U.S. Pat. No. 5,686,224 to O'Neill describes an ink jet print head that includes ink channel structures formed by patterning multiple coatings of a positive photoresist applied on a substrate. The channel structures include ink channels, heater pits and an ink manifold, each having different depths. Heating elements are located in the ink channels and heater pits are disposed over the heating elements. A cover plate covers the channel structures and includes an ink inlet for each ink manifold.

When the photoresist is used as a permanent structural layer, the openings, or features, can have various shapes and sizes. For example, the features can be relatively narrow and long, such as in lines or trenches. The sidewalls defining the features can be substantially vertical or can be tapered. Another type of opening or feature that can be formed in photoresist layers is an island. Islands are discrete upstanding structures formed on substrates. Islands have generally elongated shapes as disclosed in the incorporated Hagen reference. The opening or feature could also be a hole within an otherwise continuous area.

The features formed in photoresists can be characterized by their aspect ratio. The aspect ratio depends on both the height and width of a feature. For a typical feature, however, there will also be a certain amount of taper of the sidewalls. FIGS. 1 and 2 show two different opening configurations that have aspect ratios defined by respectively different relationships. FIG. 1 shows a photoresist layer 10 having a surface 12, and an opening 14 formed in the surface 12 having a height h and a width w. The height h can be less than or equal to the thickness of the photoresist layer 10. As shown, the side walls 16 defining the opening 14 are perpendicular to the surface 12. For this opening configuration, the aspect ratio A.R. can be defined as the ratio of the height h to the width w of the opening 14; that is, A.R.=h/w.

FIG. 2 shows a photoresist layer 20 formed on a substrate 22. A mask 24 used to pattern the photoresist layer 20 is shown positioned above the photoresist layer 20. The mask 24 includes openings 26 having a width b, and separated from each other by mask portions 25 having a width a. The photoresist layer 20 has a thickness h and includes an upper surface 28, a lower surface 30, and an opening 32 extending vertically between the upper surface 28 and the lower surface 30 and aligned with the opening b in the mask 24. The opening 32 is defined by side walls 34 which inwardly taper, such that the width of the opening 32 varies from a maximum width b' at the upper surface 28 to a minimum width b" at the lower surface 30. The photoresist layer 20 has a width a' at the upper surface 28 and a width a" at the lower surface 30. For the opening 32 having such tapered side walls 34, the average aspect ratio A.R. of the opening 32 can be defined as A.R.=2h/(b'+b"). Likewise, the average aspect ratio of the wall between the openings can be defined as A.R.=2h/(a'+a").

In addition, it is common for the aspect ratio to be described as a pair of numbers h:w (height to width of a feature).

In known methods and apparatuses, it is typical to be able to pattern a photoresist to aspect ratios of 1:1.

SUMMARY OF THE INVENTION

As described above, conventional microelectronic manufacturing techniques use polymeric photoresist layers as temporary structures. In such applications, thick film photoresists are typically patterned at aspect ratios of no more than 1:1. However, the requirements for polymeric photoresist layers that are used to form permanent structural layers in micromechanical structures in certain devices may be more demanding. Such permanent structural layers need to satisfy certain design requirements that may require aspect ratios of significantly greater than 1:1

In addition, in order to use such photoresist layers as structural layers in devices, the structural layers need to be capable of being patterned to form the desired opening (feature) configurations and patterns in the devices. In thermal ink jet devices, for example, features having significantly different aspect ratios can be required in different portions of the same ink path. For example, the range of required aspect ratios may be from about 0:∞ to as high as more than 4:1 in flow passages in a single ink jet device. This range of aspect ratios can be formed in a single layer in some embodiments. Accordingly, the photoresist layer is preferably capable of forming features with high aspect ratios, as well as a wide range of aspect ratios, in the same layer.

Furthermore, additional electronics underneath the photoresist layer may require that this variety of pattern be formed on a substrate with significant underlying topography and with a wide variety of reflectivity.

High aspect ratios can be formed in photoresist layers by forming multiple layers of a photoresist material, each patterned to an aspect ratio of no more than about 1:1. However, this approach is unsatisfactory because of the added expense of forming multiple coatings, and the difficulty of perfectly aligning and developing the features formed in the successive photoresist layers multiple times. Furthermore, subsequent layers tend to be able to achieve diminishing aspect ratio patterning, such that the amount of thickness gain diminishes with each subsequent photoresist layer.

Forming features having high aspect ratios in a single photoresist layer presents additional, difficult problems. Particularly, during the exposure step, there is typically a photoamplification effect and overexposure can occur on portions of the photoresist layer, in addition to the desired portions of the photoresist layer, that can also be exposed due to light refraction and reflection from underlying materials on the substrate or from the substrate itself Typically, the limitation on the aspect ratio that can be imaged is related to the photosensitivity of the material, its strength, and the amount of reflections from the underlying layers. At a certain point during the photoreaction process, an image would become overexposed, prohibiting the clear development of the desired pattern on the photoresist layer.

This invention provides patterned structural photoresist layers that are formed in single layers and have features with high aspect ratios and methods for creating such structures.

This invention separately provides patterned photoresist layers including features that have different shapes and sizes in the same layer and methods for creating such structures.

This invention separately provides patterned photoresist layers including features with high aspect ratios in both negative and positive photoresists and methods for creating such structures.

This invention separately provides patterned photoresist layers including features with high aspect ratios in both thick-film and thin-film photoresist layers and methods for creating such structures.

This invention separately provides patterned photoresist layers including features with significantly different aspect ratios in the same layer and methods for creating such structures.

This invention separately provides patterned photoresist layers including features with significantly different aspect ratios and/or high aspect ratios in the same layer over substrates with a variety of reflectivities.

This invention separately provides patterned photoresist layers including features with significantly different aspect ratios and/or high aspect ratios in the same layer over substrates with a substantial topography.

This invention separately provides devices that incorporate the improved patterned photoresist layers as structural layers in the devices.

This invention also separately provides methods of forming the patterned structural photoresist layers.

One exemplary embodiment of a layered structure according to this invention comprises a substrate and a permanent patterned layer formed on the substrate. The patterned layer comprises a polymeric resist material and includes a plurality of features. The features include at least two features having different aspect ratios from each other. At least one feature can also have a high aspect ratio. This invention can achieve high aspect ratios of more than 2:1 and as high as more than 4:1.

The layered structures can be formed in various devices that comprise fluid channels and in which fluid flow control is desired. One such application of the layered structures is in ink jet print heads. In exemplary embodiments of the structures and methods of this invention, the permanent patterned layers can be formed on a substrate, such as a heater plate, and a cover can be provided over the patterned layer to form ink passages in the ink jet print head.

The patterned layers can also be formed in various micromachine devices and applications, including sensors.

According to exemplary embodiments of the structures and methods according to this invention, the permanent patterned layers can be formed by applying a contrast enhancement material on the photoresist material, and then patterning the photoresist layer.

BRIEF DESCRIPTION OF THE DRAWINGS

The preferred embodiments of this invention will be described in detail, with reference to the following figures, in which.

DETAILED DESCRIPTION OF PREFERRED EMBODIMENTS

Figure 3:
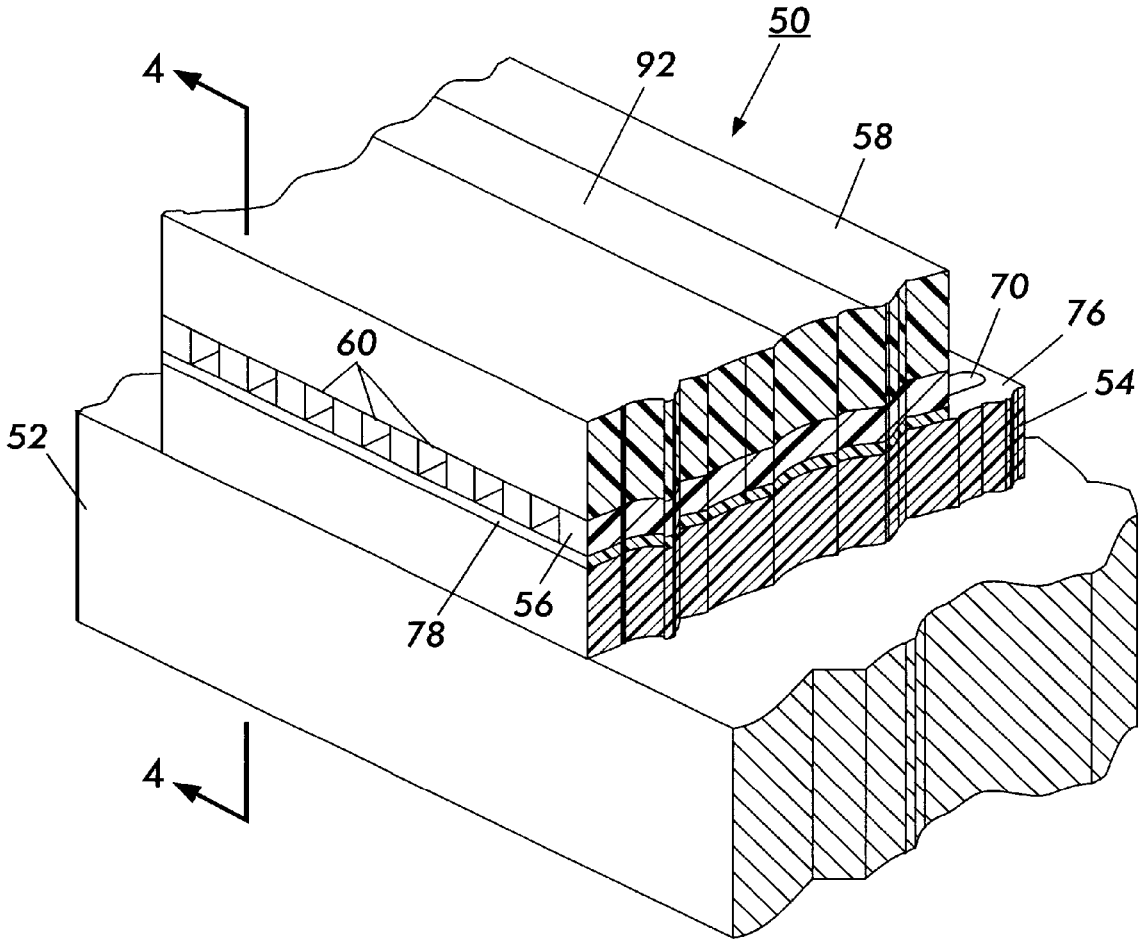
FIG. 3 illustrates a portion of an ink jet print head incorporating an exemplary embodiment of a photoresist structure according to this invention.

FIG. 3 illustrates an ink jet print head 50 incorporating an exemplary embodiment of a photoresist structure in accordance with this invention. As shown in FIG. 3, the ink jet print head 50 is mounted on a heat sink 52. However, in other embodiments, a heat sink may optionally not be used. The ink jet print head 50 comprises a heater plate 54, a patterned photoresist layer 56 provided over the heater plate 54, and a cover plate 58 provided over the photoresist layer 56. The ink jet print head 50 is oriented to show the open ends 60 of an array of ink channels formed in the photoresist layer 56.

Figure 4:
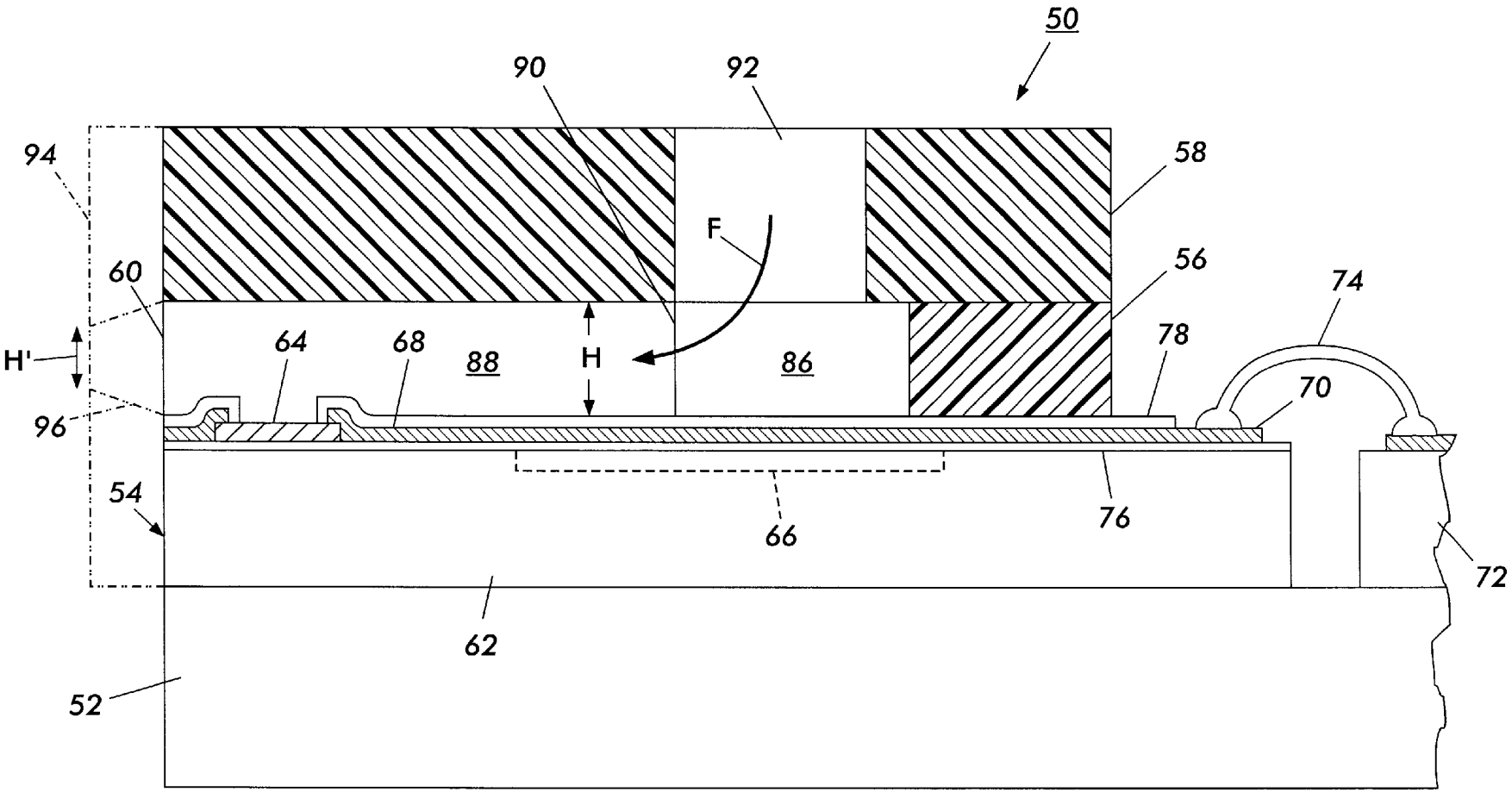
FIG. 4 is a cross-sectional view of the ink jet print head of FIG. 3 along the line 4—4.

FIG. 4 shows the structure of the ink jet print head 50 in greater detail. The heater plate 54 comprises a substrate 62, heating elements 64 (only one heating element 64 is shown), a driving circuit 66, and electrical leads 68 interconnecting the heating elements 64 and the driving circuit 66. The electrical leads 68 have contacts 70 connected to wires 74. The other ends of the wires 74 may be connected, for example, to a printed circuit board 72. The printed circuit board 72 is connected to a controller or microprocessor of the printer to selectively apply a drive pulse to the heating elements 64 to heat the ink and cause ink droplets to be ejected from the open ends 60 of the ink channels. A suitable drive circuit is described in U.S. Pat. No. 4,947,192, incorporated herein by reference in its entirety.

The substrate 62 can comprise any suitable substrate material such as silicon, glass or ceramics. The heating elements 64 can comprise any suitable resistive material. The heating elements 64 preferably comprise doped polycrystalline silicon deposited, for example, by a chemical vapor deposition (CVD) technique.

Due to the nature of the microelectronics, the surface of the substrate typically comprises different materials. These materials can have respective reflectivities that vary significantly from each other. For example, different reflectivities would be expected with materials as varied as, for example, aluminum, silicon nitride, tantalum, PSG (phosphosilicate glass) and the like.

In addition, the substrate could also have considerable underlying surface topography, from 0 microns up to at least 15 microns, due to the buildup of various layers that form the electronics and other structures on the substrates.

An insulative layer 76 can be formed between the substrate 62 and the heating elements 64, the driving circuit 66 and the electrical leads 68. The insulative layer 76 can comprise any suitable material, such as silicon dioxide.

A passivation layer 78 can be formed and patterned to expose the heating elements 64 and the contacts 70. The passivation layer 78 can comprise any suitable electrically insulative material such as, for example, silicon nitride, phosphosilicate glass, polyimide, polyarylene ether ketone, polybenzoaxole, or bisbenzocyclobutene.

As disclosed in U.S. patent application Ser. No. 09/004,765, filed Jan. 8, 1998, and incorporated herein by reference in its entirety, heating elements 64, driving circuits 66, and the electrical leads 68 can be patterned on a surface of the substrate 62, which is coated with the layer 76. The substrate 62 can then be subjected to additional process steps including cleaning, thermal oxidation and planarization. Photoresist can then be applied and patterned to form vias for electrical connections with the heating elements 64 and the driving circuit 66. Metallization can be applied to form the electrical leads 68 and to provide the contacts for connection to the printed circuit board 72.

Figure 5:
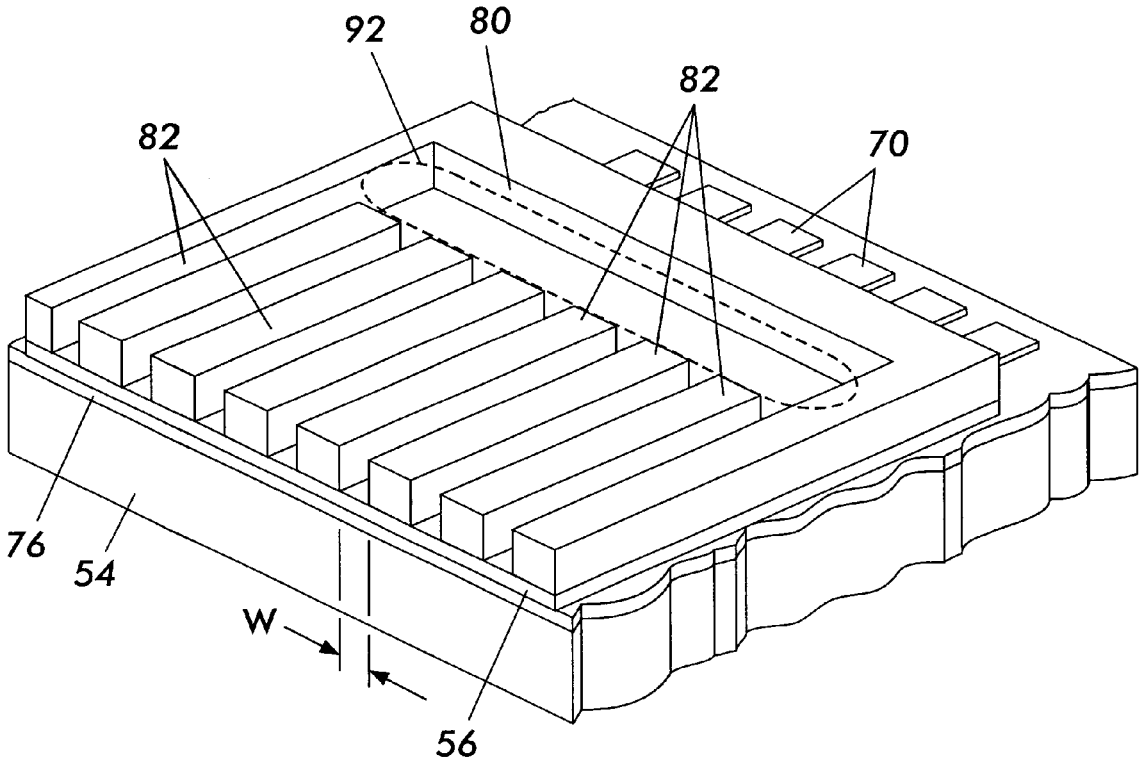
FIG. 5 is a top perspective view of the ink jet print head of FIG. 3 without the cover.

A photoresist material is deposited over the heater plate 54 and then patterned to form the photoresist layer 56. In particular, the photoresist layer 56 has a desired pattern of features to control the flow of ink through the ink jet print head 50. The photoresist layer 56 comprises a permanent structural layer in the ink jet print head 50. As shown in FIG. 5, in the ink jet print head 50, the features formed in the photoresist layer 56 include an ink reservoir groove 80 and a plurality of ink channel grooves 82. The ink channel grooves 82 are typically parallel to each other. The photoresist layer 56 is also patterned to expose the contacts 70 of the electrical leads 68.

As shown in FIG. 4, the cover plate 58 applied over the photoresist layer 56, together with the ink reservoir groove 80 and channel grooves 82 in the photoresist layer 56, define an ink reservoir 86 and ink channels 88 in the ink jet print head 50. The open end 60 of each ink channel 88 functions as an ink nozzle, and the opposed end 90 of each ink channel 88 communicates with the ink reservoir 86.

As shown in FIGS. 3–5, the cover plate 58 includes at least one aperture 92 that extends through the cover plate 58 and communicates with the ink reservoir 86. The cover plate 58 can be attached to the photoresist layer 56 using any suitable fastener, such as an adhesive.

The cover plate 58 can comprise any suitable material that is resistant to the ink. For example, the cover plate 58 can comprise glass, quartz, plastics, silicon, metals, polymers, and/or ceramics. The cover plate 58 can be formed of opaque and/or transparent materials.

Each aperture 92 in the cover plate 58 is sized to prevent, when applied over the ink reservoir groove 80 formed in the photoresist layer 56, impeding channel refill and to provide an adequate ink supply reservoir for the ink jet print head 50. The ink flow path from the ink reservoir 86 to the ink channels 88 is indicated by the arrow F shown in FIG. 4.

The cover plate 58 is typically of the same size as the substrate 62. The aperture 92 can be aligned with the ink reservoir groove 80, so that the aperture 92 is aligned with the ends 90 of the ink channels 88.

Although the cover plate 58 has been described above as having a plate-like structure, other covers can alternatively be used. Other covers that may not have a plate-like structure such as manifold-type, cover film-type or connection-clip-type covers can also be used in embodiments of this invention.

The photoresist layer 56 comprises a photosensitive polymeric material that is patterned using photolithography. If the upper surface of the patterned and cured photoresist layer 56 is uneven, the upper surface can be polished by any suitable process, such as, for example, the process disclosed in U.S. Pat. No. 5,665,249, incorporated herein by reference in its entirety. The polishing process provides a smooth and level surface for attaching the cover plate 58 to the photoresist layer 56.

A nozzle plate 94 can optionally be attached to the ink jet print head 50, as shown in FIG. 4. The nozzle plate 94 includes nozzles 96 aligned with the open ends 60 of the ink channels 88. Ink flows through the ink channels 88 and is ejected through the nozzles 96 in response to the selective activation of the heating elements 64 of the heater plate 54.

Figure 6:
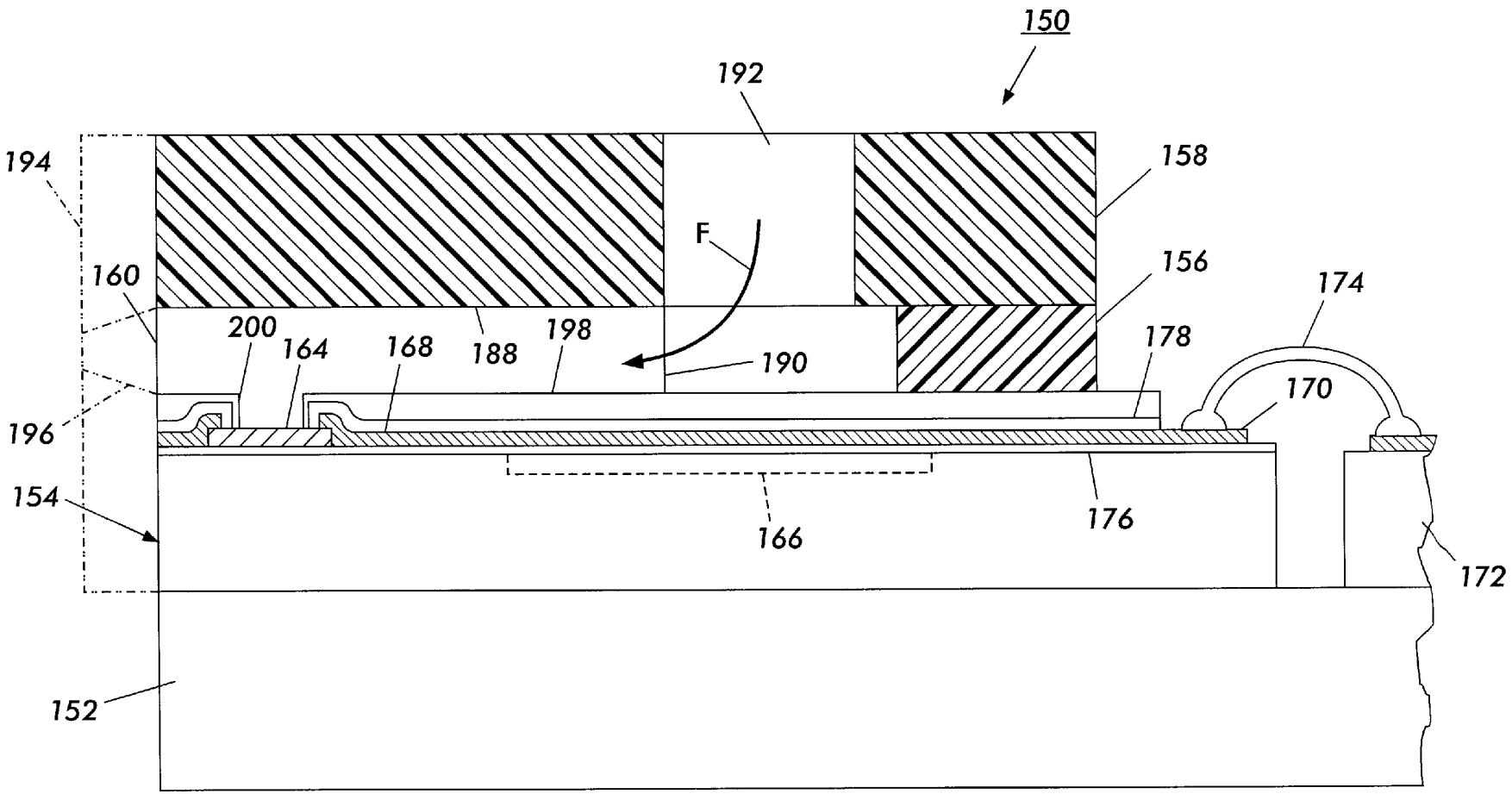
FIG. 6 is a cross-sectional view of an ink jet print head incorporating another exemplary embodiment of a photoresist structure according to this invention.

FIG. 6 is a cross-sectional view illustrating an ink jet print head 150 incorporating another exemplary embodiment of the photoresist structures according to this invention. The ink jet print head 150 includes a pit layer 198 that is patterned to form pits 200 for the heating elements 164. Except for the pit layer 198, the print head shown 150 has the same structure as the print head 50. The pit layer 198 can comprise any suitable material such as, for example, polyimide or bisbenzocyclobutene. The pit layer 198 is deposited and patterned prior to the deposition of the photoresist layer 56. The pits 200 prevent the vapor bubbles that are generated to eject ink droplets from the ink channels 188 from ingesting air. However, for high resolution ink jet print heads, the pits 200 may not be necessary.

In one embodiment, the final cured photoresist layer 56 is preferably resistant to a wide variety of solvents and chemicals including those found in inks, and has temperature stability and sufficient strength and rigidity. In addition, the photoresist layer 56 should have the right dimensions to allow the appropriate volume of ink to pass through the passageways. In addition, the photoresist material used to form the photoresist layer 56 is preferably easily diceable. Suitable photoresist materials for forming the photoresist layer 56 include, but are not limited to, materials which become polyimide, polyarylene ether ketone, Vacrel or bisbenzocyclobutene, polymethylmethacrylate when cured. An exemplary suitable polyimide material is the OCG 7500™ series of polyimide precursor materials, which are commercially available from Arch Chemical, Inc.

The photoresist material used to form the photoresist layer 56 can be applied to the heater plate 54 by any suitable technique, such as spin coating. The thickness of the applied photoresist material is dependent on the desired final thickness of the photoresist layer 56. Photoresist materials shrink significantly when heated during subsequent baking to remove the solvent, and such shrinkage needs to be taken into account in determining the desired thickness of the applied photoresist material.

In accordance with the photoresist structures and methods of this invention, the photoresist material can be either a positive resist composition or a negative resist composition. The photoresist layer can be coated to form a thickness of from about 3 microns to at least about 100 microns. Preferential selection of either a positive or negative photoresist would be dependent on a variety of other attributes including materials requirements, dimensional resolution requirements, film thickness, and other dielectric properties.

The photoresist material is preferably applied as a single layer in the ink jet print head 50. In the photoresist structures and methods of this invention, patterned single photoresist layers can be formed that provide features of different types, and with a range of aspect ratios, as well as with high aspect ratios. Accordingly, the photoresist structures and methods of this invention eliminate the need to form multiple photoresist layers in order to form features with high aspect ratios. Thus, process times and costs, as well as the problem of misalignment of features, can be reduced according to the photoresist structures and methods of this invention.

Figure 7A:
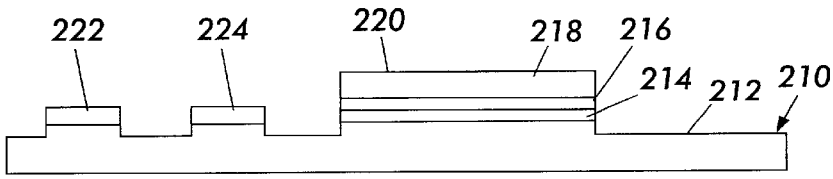
FIGS. 7A–7E illustrate process steps for forming a photoresist structure according to an exemplary embodiment of this invention.

FIGS. 7A–7E illustrate process steps of an exemplary embodiment of forming a photoresist structure according to this invention. FIG. 7A shows a portion of a substrate 210 including different electronic layers 212, 214, 216 and 218. The electronic layers 212–218 form significant topography over portions of the surface 220 of the substrate 210. The surface 220 also includes raised portions 222 and 224.

It will be understood that embodiments of this invention can be used to form photoresist structures on substrates that surfaces with various topography, as well as on surfaces that are substantially flat.

Figure 7B:
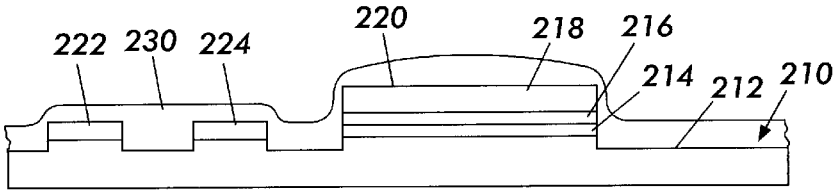

In accordance with the photoresist structures and methods of this invention, a photoresist 230 is applied over the substrate 220 as shown in FIG. 7B. The photoresist can be either a positive or negative photoresist.

Figure 7C:
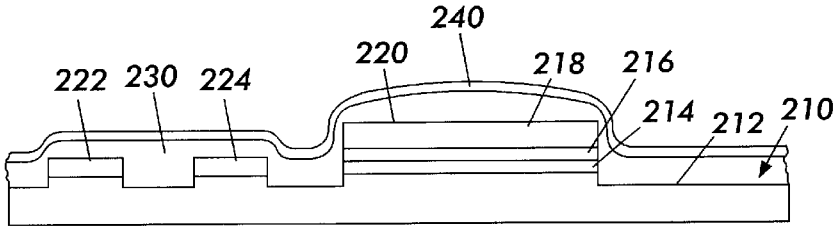

As shown in FIG. 7C, a contrast enhancement material (CEM) is then applied over the photoresist layer 230 to form a contrast enhancement material layer 240. The contrast enhancement material can be directly coated onto either positive or negative photoresist as long as the solvent for the contrast enhancement material does not affect the underlying resist. If the solvent for the contrast enhancement material affects the underlying resist, then an interlayer coating, also known as a barrier coat, is applied. This interlayer coating is transparent to the light used to expose the photoresist, but prevents the solvent in the contrast enhancement material from attacking the photoresist. Such a barrier coat can include chemicals such as the Shin-Etsu Micro-Si barrier coating BC-5, BC-6, and BC-7.5.

The contrast enhancement layer 240 absorbs some of the ultraviolet (UV) light and reduces the amount of refracted light during photolithography. As a result, the features formed in the photoresist layer 230 can have considerably straighter sidewalls and increased aspect ratios, as described in greater detail below. In addition, the features can be formed over a large amount of underlying topography as shown, and over variably reflective substrates.

The contrast enhancement material can be any suitable material for this purpose, including compositions CEM388, ACEM365, CEM365 and CEM420, commercially available from MicroSi, Inc. of Phoenix, Ariz. The use of contrast enhancement materials in photolithographic applications is disclosed in U.S. Pat. Nos. 4,578,344; 4,663,275; 4,677,049; 4,990,665; 5,002,993; 5,106,723; 5,108,874 and 5,196,295, each incorporated herein by reference in its entirety.

The contrast enhancement material can be applied over the photoresist layer 230 using any suitable coating technique such as spin coating, dip coating, or doctor blade coating. If a barrier coated is required, it is coated at this stage of the process. If no barrier coating is to be applied, the contrast enhancement material can be deposited using a coating method such as spin-coating, by a selected single or multi-step program, to produce a desired film thickness. For example, the thickness of the contrast enhancement material layer 240 can be from about 0.2 microns up to about 8 microns.

In one exemplary embodiment, the spin program includes two steps: the solution is static-dispensed with from about 2–50 ml of contrast enhancement material, then spread at low speed such as about 500 rpm for about 10 seconds, and then at a higher speed such as about 4000 rpm for about 60 seconds, resulting in a contrast enhancement material layer thickness of from about 0.1 to about 5 microns.

Figure 7D:
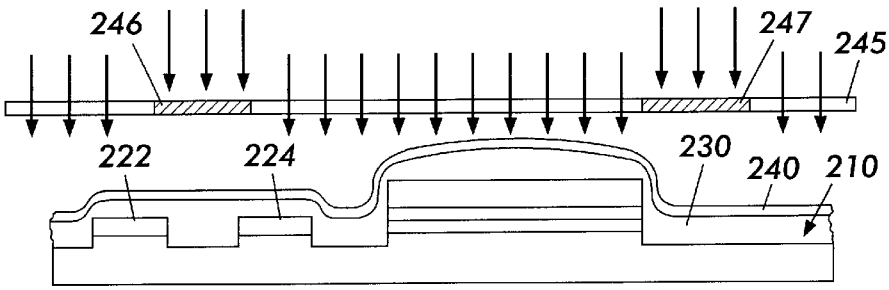

Referring to FIG. 7D, after depositing the contrast enhancement layer 240 such as MicroSi CEM 388SS over the photoresist layer 230, using a selected spin program, the photoresist layer 230 is patterned using a mask 245 that has the desired pattern of features. As shown, the mask 245 includes features 246 and 247 that form feature in the photoresist layer 230. In the illustrated process, the photoresist layer 230 comprises a negative photoresist. The photoresist layer 230 and the contrast enhancement material layer 240 are exposed using any suitable light source.

The exposed photoresist layer 230 may then be subjected to a post-exposure bake to stabilize the reaction that keeps the pattern in the polymeric layer. In one embodiment, the post-exposure bake may be conducted at temperatures of from about 60° C. to about 125° C. and for times of from about 15 seconds to about 3 hours. The post-exposure baking causes additional shrinkage of the photoresist layer 230. In such embodiments, this shrinkage is typically about 3% of the applied thickness of the photoresist layer 230. This shrinkage is also taken into account in determining the thickness of the photoresist layer 230 that needs to be applied over the substrate 210.

Figure 7E:
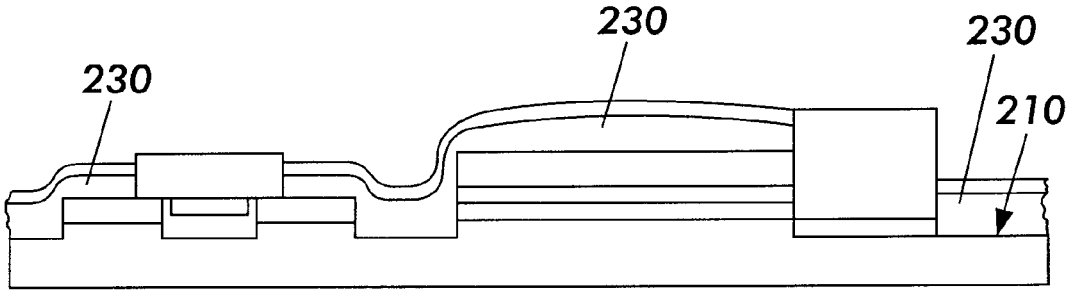

Referring to FIG. 7E, following the post-exposure baking, the photoresist layer 230 can optionally be rinsed with water or any other suitable liquid to remove the contrast enhancement material layer 240 and any barrier coat material that may have been applied from the photoresist layer 230.

The patterned photoresist layer 230 is developed using any suitable chemical that is effective to develop the particular positive or negative photoresist composition. For example, with Arch Chemicals, OCG7500 polyimide, OCG QZ-3501 developer (a butyl acetate-based solvent) or NMP may be used. In some embodiments, a partial or full cure of the photoresist films may be performed. Such cure may affect the thickness of the films, which will also affect (decrease) the apparent aspect ratio of the features formed in the films. For example, shrinkage of the OCG7500 after a full cure (virtually 100% of the imidization reaction complete) is significant, resulting in a polymeric film that is 57% of the original thickness.

According to embodiments of the process of forming the photoresist layers according to this invention, aspect ratios in a patterned photoresist layer have been achieved that range from about 0 (about 1:1000) to about 4:1, before curing. Depending on the degree of cure of the photoresist, the final apparent aspect ratio of features in the film may be less than 4:1.

FIG. 4 indicates the height H of the ink channels 88 and the ink reservoir 86. The ink channels 88 have a constant width W defined by the ink channel grooves 82, as shown in FIG. 5. The nozzle openings 96 in the nozzle plate 94 have a height that decreases from a maximum of H at the open ends 60 of the ink channels 88 to a minimum height H'.

Figure 8:
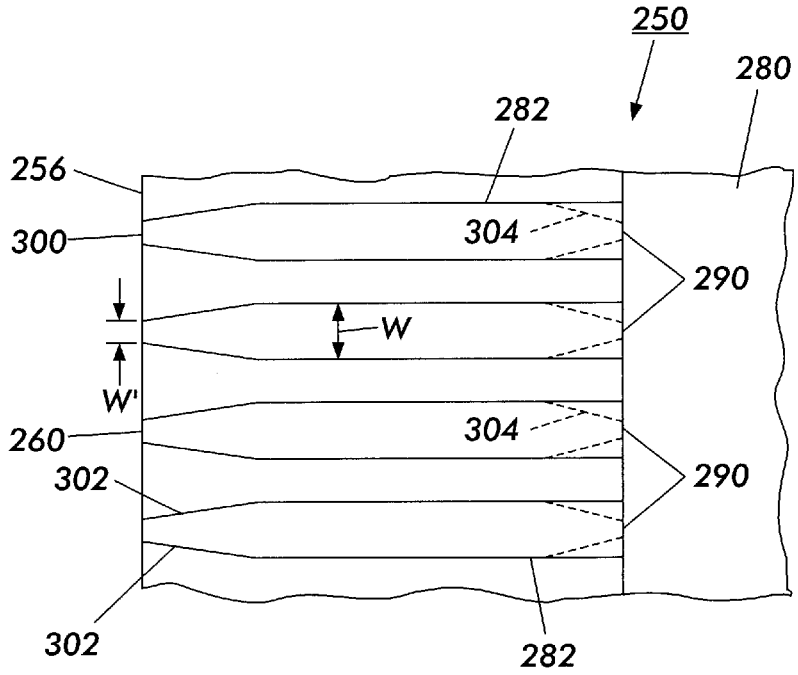
FIG. 8 illustrates another exemplary embodiment of a photoresist structure according to this invention.

FIG. 8 illustrates another exemplary embodiment of a photoresist layer 256 according to this invention. In this exemplary embodiment, the ink channels 282 include ink channel portions 300 having non-parallel sidewalls 302 adjacent to the open ends 260. In addition, the channel ends 290 that communicate with the ink reservoir 280 can also be tapered to enlarge or reduce the cross-sectional area of the ink channel entrances, as depicted in dashed lines 304. The ink channel portions 300 have a constant height and a width that varies along the length of the ink channel portions 300. As shown, the ink channel portions 300 have a maximum width W at the inlet end and a minimum width W at the outlet end. The shape of the ink channel portions 300 can simulate the effect of the nozzle plate 94 shown in FIG. 4.

In accordance with the photoresist structures and methods of this invention, the ink channel grooves 82 or 282 and the ink reservoir grooves 80 and 280, as well as any other openings formed in the photoresist layer 56 or 256, can have high aspect ratios. Particularly, the ink channel grooves 82 shown in FIG. 5 can have an aspect ratio of at least about 4:1. As explained above, the aspect ratio is defined by the ratio of the height H to the width W of an opening for openings having sidewalls that are at least substantially vertical. This definition of the aspect ratio applies to the ink channel grooves 82. The ink channels 88 have substantially constant widths defined by their parallel sidewalls. The angular range of the walls is substantially vertical (90°±5°) but can vary from the vertical by as much as about ±30°, depending on the details of the processing.

In accordance with the photoresist structures and methods of this invention, features having different aspect ratios can be formed in the same photoresist layer. For example, in the exemplary photoresist layer 256 shown in FIG. 8, the ink channel grooves 282 have an aspect ratio that varies along their lengths, due to the presence of the ink channel portions 300. The ink channel portions 300 have an aspect ratio that increases in value from that of the remainder of the ink channel grooves 282 in the direction of the ink channel grooves 282 toward the open ends 260. At the location of the open ends 260, the flow cross-sectional area is significantly reduced and the aspect ratio can be about 4:1. Another portion of the ink channel grooves 282 other than the ink channel portions 300 can have an aspect ratio of much less than about 1:1.

For the ink jet print head 50 shown in FIG. 3, the droplet volume is essentially controlled by the size of the open ends 60, or if the nozzle plate 94 is used, by the outside opening of the nozzles 96. The required droplet volume for different colored inks can be achieved by changing the dimensions of the ink channels through which the different inks respectively flow. The ability to form features having different aspect ratios enables the formation of ink channels 82 or 282 having different sizes and different aspect ratios in the same photoresist layer 56 or 256.

Figure 1:
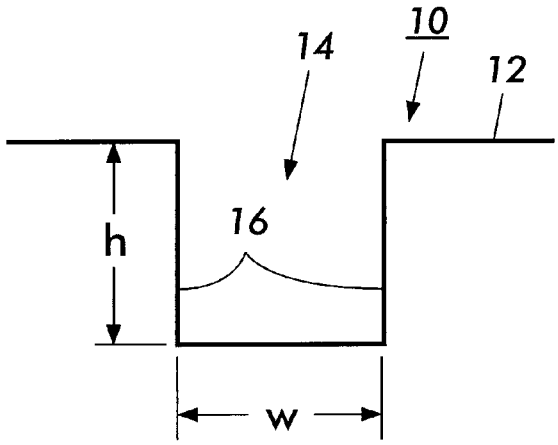
FIG. 1 illustrates an opening in a photoresist layer that includes vertical side walls.
Figure 2:
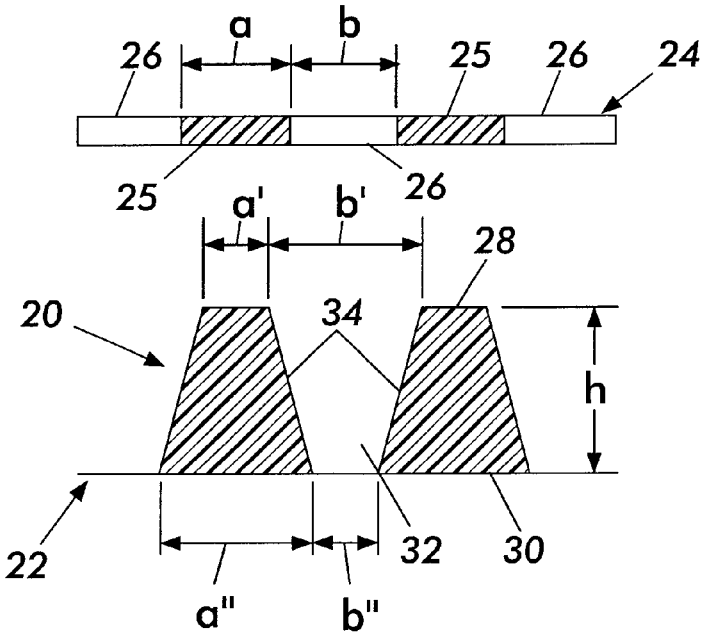
FIG. 2 illustrates a photoresist structure including an opening having inwardly tapered side walls formed on a substrate, and a mask for forming the features positioned above the photoresist layer.

The above-described features (i.e., the ink channel grooves 82 and 282 and the ink reservoir grooves 80 and 280) formed in the photoresist layers of the exemplary ink jet print heads have substantially vertical sidewalls. The sidewalls can optionally be formed with tapered side walls, as shown in FIG. 2.

Figure 9:
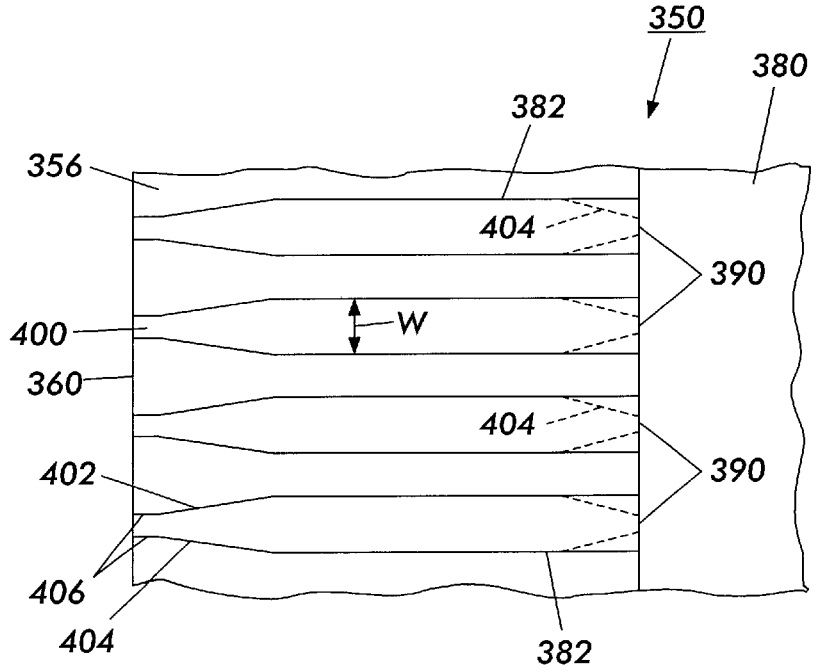
FIG. 9 illustrates another exemplary embodiment of a photoresist structure according to this invention.

FIG. 9 shows another exemplary embodiment of a photoresist layer 356 in which the ink channels 382 include ink channel portions 400 having non-parallel sidewalls 402 that converge into parallel end portions 406 adjacent to the open ends 360. In addition, the opposed channel ends 390 that communicate with the ink reservoir 380 can also be tapered to enlarge or reduce the cross-sectional area of the ink channel entrances, as depicted in dashed lines 404. The channel ends 390 can also include parallel end portions such as the end portions 406.

Figure 10:
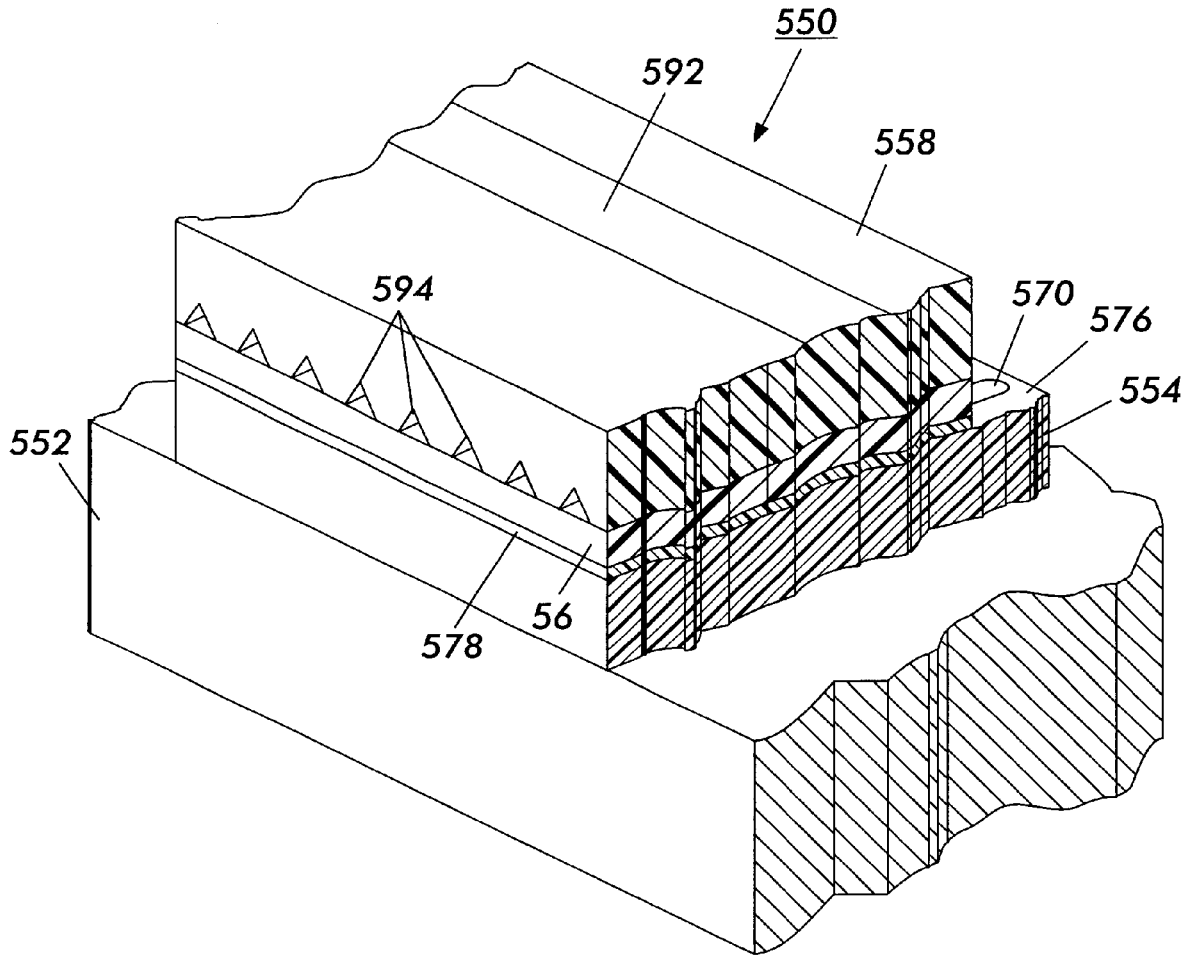
FIG. 10 illustrates another exemplary embodiment of a photoresist structure according to this invention.

Referring to FIG. 10, in some embodiments, the cover 558 can optionally be patterned to form features, such as the generally triangular shaped features 594. The features formed in the cover 558 can have various sizes, shapes, aspect ratios and ranges of aspect ratios, as in the ink jet print head 50 described above.

In addition, the above-described features shown in FIG. 5 extend completely through the thickness of the photoresist layer. Such features are typically referred to as vias. However, the features can also be formed to extend through only a portion of the thickness of the photoresist layers, to form lines or other like features. Furthermore, the above-described features are each generally elongated in configuration. It will be understood by those skilled in the art that the features can have various dimensions, depending on their function.

Furthermore, although the patterned photoresist layers according to this invention have been described above with respect to thermal ink jet print heads, it will be understood by those skilled in the art that the patterned photoresist layers can be formed in other types of ink jet print heads such as acoustic ink jet print heads, piezoelectric printheads, and other heads that eject materials (liquid/solid blends/mixtures/combinations, solids that are in liquid phase when ejected, and the like).

In addition, the patterned photoresist layers according to this invention can be formed in other types of devices in which it would be advantageous to form features of different types and with high aspect ratios, controlled side wall tapers and aspect ratio ranges, especially in a single photoresist layer. Such features are advantageous for providing controlled fluid flow as well as other important functions such as vias to the underlying circuitry.

For example, the patterned photoresist layers can be formed in various micromachine applications including micro sensors. Exemplary micro sensors include pressure sensors, capacitive sensors and the like. In micro capacitive displacement sensors (linear and non-linear output types), the finger spacing and finger height can be varied using the processes of this invention, to form controlled spacings between the fingers, having varied as well as high aspect ratios, to improve capacitor performance. Known capacitive displacement and pressure sensors to which processes of this invention can be applied are available from Sandia National Laboratories, Intelligent Micromachine Department.

It will also be understood by those skilled in the art that other types of features such as islands can also be formed in the photoresist layers. For example, embodiments of this invention can be used to form island features in photoresist layers, to form filter structures for removing debris and/or allowing for management of gas bubbles in a device such as an ink jet printhead. Due to the wide range of feature aspect ratios that can be achieved using this invention, filter structures could be formed to provide a range of selected filtration characteristics. For example, a single layer photoresist structure can advantageously be formed in which the filtration capabilites vary at different portions of the structure, to enable filtration over a range of levels. For example, filter structures could be formed to provide series filtration capabilities to remove progressively finer debris from a medium.

While the invention has been described in conjunction with the specific embodiments described above, it is evident that many alternatives, modifications and variations are apparent to those skilled in the art. Accordingly, the preferred embodiments of the invention as set forth above are intended to be illustrative and not limiting. Various changes can be made without departing from the spirit and scope of the invention.

What is claimed is:

1. A method of making an inkjet print head, comprising:

applying a polymeric resist material over a substrate; forming a single permanent patterned layer, having a plurality of features, in the polymeric resist material; and forming a plurality of ink passages using the plurality of features, wherein: each of the features of the plurality of features has a height and a width, and the plurality of features includes at least two features having different aspect ratios from each other, and at least one feature having an aspect ratio of at least about 2:1.

2. The method of claim 1, wherein the polymeric resist material comprises a polyimide resist material.

3. The method of claim 1, wherein at least one of the plurality of features has an aspect ratio of at least about 4:1.

4. The method of claim 1, wherein the plurality of features includes features having an aspect ratio of from about 0 to at least about 4:1.

5. The method of claim 1, wherein the plurality of features includes features selected from the group consisting of vias, islands, lines and holes.

6. The method of claim 1, wherein the polymeric resist material is a negative resist material.

7. The method of claim 1, wherein the polymeric resist material is a positive resist material.

8. The method of claim 1, wherein at least one of the plurality of features has an aspect ratio that varies along at least one dimension of each such feature.

9. The method of claim 1, wherein the substrate includes a surface having regions of different reflectivities from each other, and the permanent patterned layer is formed over the regions.

10. The method of claim 1, wherein the substrate includes a surface having a topography up to about 15 microns, and the permanent patterned layer is formed over the surface.

11. The method of claim 1, wherein the plurality of features includes features having substantially vertical sidewalls.

12. The method of claim 1, wherein the plurality of features includes at least two features selected from the group consisting of vias, islands, lines and holes.

13. The method of claim 12, wherein the at least two features each have an aspect ratio of at least about 4:1.

14. The method of claim 1, wherein each of the plurality of features is one feature selected from the group consisting of vias, islands, lines and holes.

15. The method of claim 1, wherein the polymeric resist material is a material that becomes polyimide when cured.

16. The method of claim 1, wherein the polymeric resist material is selected from the group consisting of materials that become polyarylene ether ketone, bisbenzocyclobutene and polymethylmethacrylate when cured.

17. The method of claim 1, wherein the permanent patterned layer is formed by photolithography.

* * * * *